US010216122B2

(12) United States Patent
Nakai et al.

(10) Patent No.: US 10,216,122 B2
(45) Date of Patent: Feb. 26, 2019

(54) IMAGE FORMING APPARATUS

(71) Applicant: CANON KABUSHIKI KAISHA, Tokyo (JP)

(72) Inventors: Tomoaki Nakai, Numazu (JP); Takamitsu Soda, Mishima (JP); Masaki Shimomura, Mishima (JP); Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/603,843

(22) Filed: May 24, 2017

(65) Prior Publication Data

US 2017/0351201 A1 Dec. 7, 2017

(30) Foreign Application Priority Data

Jun. 2, 2016 (JP) ..... 2016-111356

(51) Int. Cl.
*G03G 15/00* (2006.01)
*G03G 15/16* (2006.01)

(52) U.S. Cl.
CPC ..... *G03G 15/1665* (2013.01); *G03G 15/161* (2013.01); *G03G 15/80* (2013.01)

(58) Field of Classification Search
CPC ..... G03G 15/1665
See application file for complete search history.

(56) References Cited

U.S. PATENT DOCUMENTS 7,113,713 B2 9/2006 Soda et al.
2014/0010568 A1 1/2014 Takayama et al.
2014/0147146 A1* 5/2014 Kobayashi ..... G03G 15/161 399/66
2017/0285554 A1* 10/2017 Iwasawa ..... G03G 21/0023
2018/0074451 A1* 3/2018 Izaki ..... G03G 15/80

FOREIGN PATENT DOCUMENTS

JP 09-50167 A 2/1997
JP 2014-016462 A 1/2014
JP 2014-098936 A 5/2014

OTHER PUBLICATIONS

Co-pending U.S. Appl. No. 15/460,745, filed Mar. 16, 2017, inventors Yasuharu Hirado, Masaki Shimomura, Yusaku Iwasawa.

* cited by examiner

*Primary Examiner* — David M. Gray
*Assistant Examiner* — Michael A Harrison
(74) *Attorney, Agent, or Firm* — Venable LLP

(57) ABSTRACT

The image forming apparatus includes a charge power source and a controller. The charge power source is configured to switch a voltage with the same polarity as an original charging polarity of a toner and a voltage with a polarity opposite to the original charging polarity of the toner and apply the voltages to a charge device. The controller executes a control of switching a polarity of a voltage to be applied from the charge power source to the charge device from the opposite polarity to the same polarity before termination of secondary transfer of all of toner images in a job, and moving both a residual toner charged to the opposite polarity through application of the voltage with the opposite polarity and a residual toner charged to the same polarity through application of the voltage with the same polarity to an image bearing member.

9 Claims, 7 Drawing Sheets

IMAGE FORMING APPARATUS

BACKGROUND OF THE INVENTION

Field of the Invention

The present invention relates to an image forming apparatus, for example, a copying machine, a printer, or a facsimile machine, which uses an electrophotographic system or an electrostatic recording system.

Description of the Related Art

Hitherto, for example, as an image forming apparatus using an electrophotographic system, there has been known an image forming apparatus using an intermediate transfer system. In the intermediate transfer system, toner images formed on photosensitive members serving as image bearing members are primarily transferred onto an intermediate transfer member and thereafter secondarily transferred onto a transfer material such as paper.

In Japanese Patent Application Laid-Open No. H09-50167, the following method is disclosed. A residual toner, which remains on the intermediate transfer member without being transferred onto a transfer material, is charged to a polarity opposite to an original charging polarity of the toner, and thereafter is moved from the intermediate transfer member to the photosensitive member simultaneously with the primary transfer. The residual toner which is moved to the photosensitive member is collected by a photosensitive member cleaning unit configured to clean the photosensitive member.

In Japanese Patent Application Laid-Open No. H09-50167, the residual toner on the intermediate transfer member is charged to the polarity opposite to the original charging polarity of the toner. As a result, there is a case where an electrostatic attractive force between the residual toner and the photosensitive member acts more strongly than an electrostatic attractive force between the toner charged to the original charging polarity and the photosensitive member. Typically, that is a case where the photosensitive member is charged to the same polarity as the original charging polarity of the toner. Therefore, there is a case where cleaning performance for the photosensitive member is degraded.

As a countermeasure for such a problem, it is conceivable to make improvement in cleaning performance of the photosensitive member cleaning unit. However, improvement in cleaning performance may shorten a lifetime of the photosensitive member and the like. For example, as the photosensitive member cleaning unit, there has often been used a cleaning blade (rubber blade) being a cleaning member arranged in abutment against the photosensitive member. In order to improve the cleaning performance of the cleaning blade, it is conceivable to increase an intrusion amount or a contact pressure of the cleaning blade with respect to the photosensitive member. However, in such a case, rubbing of the photosensitive member and the cleaning blade may increase the amount of abrasion of the photosensitive member and the cleaning blade. As a result, the lifetime of the photosensitive member and the cleaning blade may be shortened.

As described above, in consideration of the cleaning performance for the photosensitive member and the lifetime of the photosensitive member and the cleaning blade, it is desired that the amount of toner, which is to be charged to the polarity opposite to the original charging polarity and is to be moved from the intermediate transfer member to the photosensitive member, be as small as possible.

SUMMARY OF THE INVENTION

According to one embodiment of the present invention, there is provided an image forming apparatus, including an image bearing member configured to bear a toner image thereon, an intermediate transfer member configured to secondarily transfer the toner image transferred from the image bearing member at a primary transfer portion, onto a transfer material at a secondary transfer portion, a charge device configured to charge a toner on the intermediate transfer member at a charging portion downstream of the secondary transfer portion and upstream of the primary transfer portion with respect to a moving direction of the intermediate transfer member, the toner charged by the charge device being moved at the primary transfer portion from the intermediate transfer member to the image bearing member, a charge power source capable of switching a voltage with the same polarity as an original charging polarity of the toner and a voltage with a polarity opposite to the original charging polarity of the toner and applying the voltages to the charge device, and a controller configured to execute a control of switching the polarity of the voltage to be applied from the charge power source to the charge device from the opposite polarity to the same polarity before termination of the secondary transfer of all of toner images in a job, and moving both of a residual toner, which is charged to the opposite polarity through application of the voltage with the opposite polarity to the charge device, on the intermediate transfer member and a residual toner, which is charged to the same polarity through application of the voltage with the same polarity to the charge device, on the intermediate transfer member, to the image bearing member.

Further features of the present invention will become apparent from the following description of exemplary embodiments with reference to the attached drawings.

DESCRIPTION OF THE EMBODIMENTS

Now, an image forming apparatus according to the present invention is described in detail with reference to the attached drawings.

[First Embodiment]

1. Overall Configuration and Operation of Image Forming Apparatus

Figure 1:
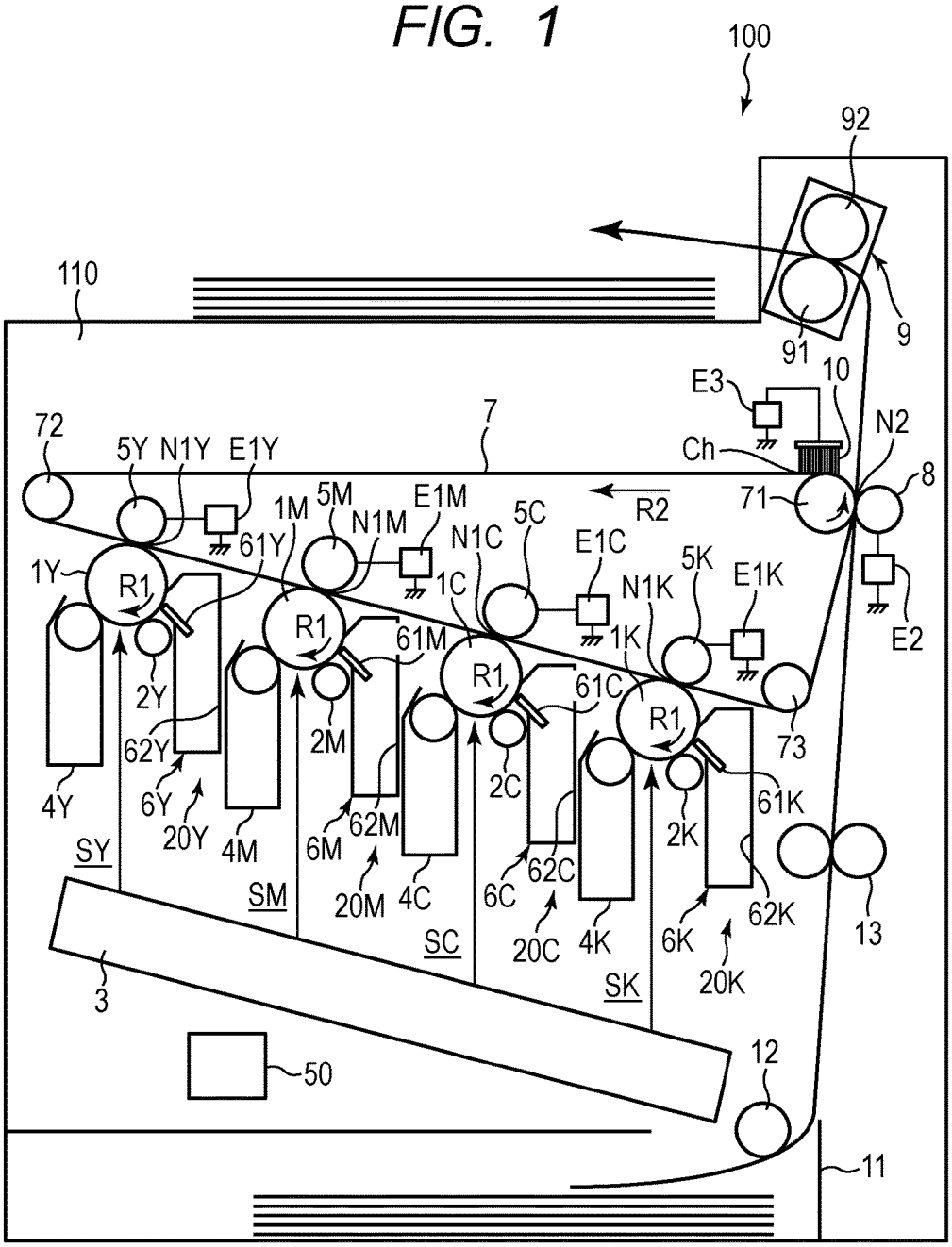
FIG. 1 is a schematic vertical sectional view of an image forming apparatus according to a first embodiment of the present invention.

FIG. 1 is a schematic vertical sectional view of an image forming apparatus 100 according to a first embodiment of the present invention. The image forming apparatus 100 according to the first embodiment is an in-line type color printer employing an intermediate transfer system, which is capable of forming a full-color image using an electrophotographic system.

The image forming apparatus 100 includes, as a plurality of image forming portions, a first image forming portion SY configured to form a yellow image (Y), a second image forming portion SM configured to form a magenta image (M), a third image forming portion SC configured to form a cyan image (C), and a fourth image forming portion SK configured to form a black image (K). Components having the same or corresponding function or configuration in the image forming portions SY, SM, SC, and SK are sometimes collectively described without the suffixes Y, M, C, and K of the reference symbols, which respectively denote colors for which the components are provided. In the first embodiment, the image forming portion S includes a photosensitive member 1, a charging roller 2, an exposure device 3, a developing device 4, a primary transfer roller 5, and a photosensitive member cleaning device 6, which are described later.

The image forming apparatus 100 includes four drum-shaped photosensitive members (photosensitive drums) 1 serving as a plurality of image bearing members, which are arrayed along a moving direction of an intermediate transfer belt 7 described later and are configured to bear toner images. The photosensitive member 1 is rotationally driven in a direction indicated by the arrow R1 (clockwise direction) in FIG. 1. A surface of the rotated photosensitive member 1 is uniformly charged to a predetermined potential with a predetermined polarity (negative polarity in the first embodiment) by the charging roller 2 being a charging device. The charged surface of the photosensitive member 1 is scanned and exposed to light in accordance with image information by the exposure device (laser scanner) 3 serving as an exposure unit. As a result, an electrostatic latent image (electrostatic image) is formed on the photosensitive member 1. In the first embodiment, the exposure device 3 is constructed as a single unit configured to expose the photosensitive members 1 of the image forming portions S.

The electrostatic latent image formed on the photosensitive member 1 is developed (visualized) by the developing device 4 serving as a development unit using a toner serving as a developer, thereby forming a toner image on the photosensitive member 1. In the first embodiment, the toner charged to the same polarity (negative polarity in the first embodiment) as the charging polarity of the photosensitive member 1 adheres onto an exposed portion on the photosensitive member 1, which has a reduced absolute value of the potential through the exposure to light after the uniform charging process.

The intermediate transfer belt 7 made up of an endless belt serving as an intermediate transfer member is arranged so as to be opposed to the four photosensitive members 1. The intermediate transfer belt 7 is looped around a drive roller (secondary transfer opposed roller) 71, a tension roller 72, and an idler roller 73 serving as a plurality of stretch rollers so as to be tensioned with a predetermined tension. On an inner circumferential surface side of the intermediate transfer belt 7, primary transfer rollers 5 being roller-type primary transfer members serving as primary transfer units are arranged so as to respectively correspond to the photosensitive members 1. The primary transfer roller 5 is pressed toward the photosensitive member 1 through the intermediate transfer belt 7 so as to form a primary transfer portion (primary transfer nip) N1 at which the photosensitive member 1 and the intermediate transfer belt 7 come into contact with each other.

The toner image formed on the photosensitive member 1 as described above is electrostatically transferred (primarily transferred) at the primary transfer portion N1 onto the intermediate transfer belt 7 being rotated in the direction of the arrow R2, that is, in a counter-clockwise direction in FIG. 1. During a primary transfer step, a primary transfer voltage (primary transfer bias) being a direct-current voltage with a polarity opposite to the charging polarity (original charging polarity) of the toner at the time of development is applied from a primary transfer power source E1 to the primary transfer roller 5. For example, at the time of formation of a full-color image, the toner images of yellow, magenta, cyan, and black formed respectively on the photosensitive members 1 are sequentially transferred onto the intermediate transfer belt 7 so as to be overlapped with each other.

At a position opposed to the drive roller 71, which also serves as the secondary transfer opposed roller, on an outer circumferential surface side of the intermediate transfer belt 7, a secondary transfer roller 8 being a roller-type secondary transfer member serving as a secondary transfer unit is arranged. The secondary transfer roller 8 is pressed toward the drive roller 71 through intermediation of the intermediate transfer belt 7 to form a secondary transfer portion (secondary transfer nip) N2 at which the intermediate transfer belt 7 and the secondary transfer roller 8 come into contact with each other.

The toner images formed on the intermediate transfer belt 7 as described above are electrostatically transferred (secondarily transferred) onto a transfer material (recording medium or sheet) P, for example, paper nipped between the intermediate transfer belt 7 and the secondary transfer roller 8 to be conveyed at the secondary transfer portion N2. During a secondary transfer step, a secondary transfer voltage (secondary transfer bias) being a direct-current voltage with the polarity opposite to the original charging polarity of the toner is applied from a secondary transfer power supply E2 to the secondary transfer roller 8. The transfer material P is received in a cassette 11, and is separated and fed one after another by a feed roller 12 to be conveyed to a conveyance roller pair 13. Then, the transfer material P is fed by the conveyance roller pair 13 to the secondary transfer portion N2 in conformity with a timing of the toner images on the intermediate transfer belt 7.

The transfer material P having the toner images transferred thereon is conveyed to a fixing device 9 serving as a fixing unit. The fixing device 9 includes a heating roller 91 and a pressure roller 92. The heating roller 91 is a heating member including a heat source. The pressure roller 92 is a pressurizing member to be brought into press-contact with the heating roller 91. The transfer material P is heated and pressurized by the heating roller 91 and the pressure roller 92 so that the toner images are fixed (melted and caused to firmly adhere) to a surface of the transfer material P. Thereafter, the transfer material P is discharged (output) to an outside of an apparatus main body 110 of the image forming apparatus 100.

Meanwhile, the residual toner remaining on the photosensitive member 1 after the primary transfer step is removed from the photosensitive member 1 to be collected by the photosensitive member cleaning device 6 serving as a photosensitive member cleaning unit. Removal of the residual toner which remains on the intermediate transfer belt 7 after the secondary transfer step is described later.

In the first embodiment, the photosensitive member 1 and process units including the charging roller 2, the developing device 4, and the photosensitive member cleaning device 6, which act on the photosensitive member 1, are integrally assembled into a cartridge, thereby forming a process cartridge 20 which is removably mounted to the apparatus main body 110.

In the first embodiment, the photosensitive member 1 is constructed by applying an organic photoconductor layer (OPC photosensitive member) to an outer peripheral surface of an aluminum cylinder having a diameter of 30 mm.

In the first embodiment, the charging roller 2 is a conductive roller formed into a roller shape, and is arranged in abutment against a surface of the photosensitive member 1. During a charging step, a predetermined charging voltage (charging bias), which is equal to or higher in an absolute value than a discharge start voltage with a negative polarity, is applied from a charge power source (not shown).

In the first embodiment, the primary transfer roller 5 is a conductive roller formed into a roller shape. The primary transfer roller 5 includes a shaft being made of metal such as SUS and having an outer diameter of 6 mm, and a foamable elastic material is provided around the shaft so that the primary transfer roller 5 has an outer diameter of 12 mm. The primary transfer roller 5 has an electric resistance of from $10^6\Omega$ to $10^9\Omega$. In the first embodiment, primary transfer power sources E1Y, E1M, E1C, and E1K are independently connected to the primary transfer rollers 5Y, 5M, 5C, and 5K, respectively. In the first embodiment, each primary transfer power source E1 is capable of switching a voltage with the same polarity as the original charging polarity of the toner and a voltage with a polarity opposite to the original charging polarity of the toner and applying the voltages to the corresponding primary transfer roller 5. The primary transfer rollers 5Y, 5M, 5C, and 5K correspond to an example of a plurality of primary transfer members configured to primarily transfer the toner images from the photosensitive members 1 to the intermediate transfer belt 7 at the respective plurality of primary transfer portions N1 corresponding to the plurality of photosensitive members 1.

In the first embodiment, the intermediate transfer belt 7 is formed of an endless film type member having a specific volume resistivity of from $10^7$ Ω·cm to $10^{14}$ Ω·cm and a thickness of from about 50 μm to about 150 μm. The above-mentioned specific volume resistivity is a value obtained by using a measurement probe conforming to JIS K6911 and a high resistance meter R2340 manufactured by ADVANTEST CORPORATION, at a temperature of 25° C. and a relative humidity of 50%, and applying a voltage of from 50 V to 100 V. The intermediate transfer belt 7 is an example of an intermediate transfer member configured to convey the toner images, which are transferred from the photosensitive members 1 at the primary transfer portions N1, to secondarily transfer the toner images to the transfer material P at the secondary transfer portion N2.

Further, in the first embodiment, the photosensitive member cleaning device 6 includes a cleaning blade 61 and a collection container 62. The cleaning blade 61 is a cleaning member arranged in abutment against the photosensitive member 1. The collection container 62 is configured to receive the residual toner removed by the cleaning blade 61 from the photosensitive member 1. The cleaning blade 61 is formed of plate-shaped elastic rubber. The photosensitive member cleaning device 6 is configured to scrape off the residual toner from a surface of the rotated photosensitive member 1 with the cleaning blade 61 and collect the residual toner in the collection container 62. Through replacement of the process cartridge 20, the residual toner collected in the photosensitive member cleaning device 6 is disposed of together with the process cartridge 20 removed from the apparatus main body 110.

2. Cleaning for Intermediate Transfer Belt

The image forming apparatus 100 includes a cleaning brush 10 being a brush type charge member serving as a charge device configured to charge the toner on the intermediate transfer member. The cleaning brush 10 is arranged so as to charge the toner on the intermediate transfer belt 7 at a charging portion Ch on downstream of the secondary transfer portion N2 and on upstream of the primary transfer portion N1 (primary transfer portion N1Y on the uppermost stream) in the moving direction (conveying direction) of the intermediate transfer belt 7. In particular, in the first embodiment, the cleaning brush 10 is arranged in contact with the surface of the intermediate transfer belt 7 at a position opposed to the drive roller 71, which also serves as a secondary transfer opposed roller, through intermediation of the intermediate transfer belt 7.

Further, in the first embodiment, the residual toner which remains on the intermediate transfer belt 7 without being transferred onto the transfer material P at the secondary transfer portion N2 is charged by the cleaning brush 10 at the charging portion Ch, and is moved from the intermediate transfer belt 7 to the photosensitive member 1 at the primary transfer portion N1 so as to be collected.

In the first embodiment, the cleaning brush 10 is constructed by a brush having a configuration in which conductive nylon fibers having an electric resistance of $10^6\Omega$ to $10^9\Omega$ are substantially dense. A width of the cleaning brush 10 in the moving direction of the intermediate transfer member 7 is 4 mm. A length of the cleaning brush 10 in a longitudinal direction substantially orthogonal to the moving direction of the intermediate transfer belt 7 is larger than a width of a region on the intermediate transfer belt 7 where the toner images can be borne. Further, the cleaning brush 10 is pressed against the drive roller 71 through intermediation of the intermediate transfer belt 7 so that tips of the brush fibers are positioned with an intrusion amount of 1.0 mm with respect to the surface of the intermediate transfer belt 7. The cleaning brush 10 is arranged at a fixed position with respect to the moving intermediate transfer belt 7, and rubs the surface of the intermediate transfer belt 7 along with movement of the intermediate transfer belt 7.

As described above, the related-art method of charging the residual toner on the intermediate transfer member to the polarity opposite to the original charging polarity of the toner and moving the residual toner to the photosensitive member so as to be collected has a problem in that there is difficulty in achieving both the cleaning performance for the photosensitive member and the durability of the photosensitive member and the cleaning blade. Therefore, it is desired that the amount of toner, which is to be charged to the polarity opposite to the original charging polarity and is to be moved from the intermediate transfer member to the photosensitive member, be as small as possible.

Further, the related-art method of charging the residual toner on the intermediate transfer member to the polarity opposite to the original charging polarity of the toner and moving the residual toner to the photosensitive member so as to be collected also has the following another problem. That is, in terms of the electric charge of the residual toner on the intermediate transfer member, the toner charged to the same polarity as the original charging polarity of the toner is larger in amount. Accordingly, in order to charge the residual toner to the polarity opposite to the original charging polarity of toner with the charge amount suitable for movement to the photosensitive member, it is necessary to increase the voltage and current to be applied to the charge member. However, in such a case, discharge products become more liable to be generated on the charge member. The discharge products may adhere to a conductive path and act as a matter which inhibits movement of the electric charge, with the result that an increase in electric resistance of the charge member is promoted. In consideration of the manufacturing cost, space, and the like for the image forming apparatus, there is a limit in output of the high-voltage power source. Therefore, it is desired that increase in electric resistance of the charge member be suppressed. Further, the adhesion of the discharge products to the charge member may cause degradation in charging performance for the residual toner on the intermediate transfer member of the charge member, with the result that the cleaning performance for the intermediate transfer member is degraded.

Further, the related-art method of charging the residual toner on the intermediate transfer member to the polarity opposite to the original charging polarity of the toner and moving the residual toner to the photosensitive member so as to be collected also has the following another problem. That is, the toner charged to the original charging polarity without being charged to the polarity opposite to the original charging polarity of the toner may electrostatically adhere to the charge member and be gradually accumulated. Therefore, in order to maintain the charging performance of the charge member, there has been known an operation of discharging the toner accumulated on the charge member to the intermediate transfer member during a period corresponding to a period between images in a job, that is, during a time period between sheets. However, there is a case where the toner cannot be sufficiently discharged from the charge member when the time period between sheets is short. When the time period between sheets is extended to sufficiently discharge the toner from the charge member, the number of sheets to be printed per unit time is reduced.

Therefore, in the first embodiment, the image forming apparatus 100 includes a charge power source E3 capable of switching a voltage with a negative polarity being the same as the original charging polarity of the toner and a voltage with a positive polarity being opposite to the original charging polarity of the toner and applying the voltages to the cleaning brush 10. Further, in the first embodiment, the image forming apparatus 100 includes a controller 50 configured to switch the polarity of the voltage to be applied from the charge power source E3 to the cleaning brush 10 from the positive polarity to the negative polarity before termination of the secondary transfer of all the toner images in a job. Then, the controller 50 executes a control of moving both of the residual toner, which is charged to the positive polarity through application of the voltage with the positive polarity, on the intermediate transfer belt 7 and the residual toner, which is charged to the negative polarity through application of the voltage with the negative polarity, on the intermediate transfer belt 7, to the photosensitive member 1. In particular, in the first embodiment, the residual toner on the intermediate transfer belt 7 is moved to the photosensitive member 1Y for yellow at the primary transfer portion N1Y for yellow arranged on the uppermost stream in the moving direction of the intermediate transfer belt 7. Then, the residual toner is collected by the photosensitive member cleaning device 6 for yellow. Further, in the first embodiment, the controller 50 switches the polarity of the voltage before termination of the secondary transfer of all of the toner images in the job. As a result, the residual toner adhering to the cleaning brush 10 can be moved or discharged to the intermediate transfer belt 7. Herein, the job (print job) is a series of sequence of performing printing (image output operation) of transferring and outputting toner images to one or a plurality of transfer materials P in accordance with one start instruction.

In the first embodiment, the charge power source (high-voltage power source circuit) E3 is capable of applying a voltage (cleaning voltage) of from −2.0 kV to +2.0 kV to the cleaning brush 10.

It is required that the cleaning brush 10 charge the residual toner on the intermediate transfer belt 7 to the amount of electric charge suitable for electrostatically moving (reversely transferring) the residual toner to the photosensitive member 1. In the first embodiment, the voltage to be applied to the cleaning brush 10 is set to +1.5 kV for the positive polarity and to −1.2 kV for the negative polarity. That is, in the first embodiment, an absolute value of the voltage with the same polarity as the original charging polarity of the toner to be applied to the cleaning brush 10 is smaller than an absolute value of the voltage with the polarity opposite to the original charging polarity of the toner to be applied to the cleaning brush 10. The absolute value of the voltage is varied in accordance with the polarity of the voltage to be applied to the cleaning brush 10 for the following reason.

In the first embodiment, the original charging polarity of the toner is the negative polarity, and a secondary transfer voltage with the positive polarity is applied to the secondary transfer roller 8 during the secondary transfer step. Therefore, some residual toner on the intermediate transfer belt 7 is charged to the positive polarity due to electric discharge with the transfer material P, but most of the residual toner is charged to the negative polarity. Accordingly, in order to charge the residual toner to the amount of electric charge suitable for moving the residual toner to the photosensitive member 1, the absolute value of the voltage to be applied to the cleaning brush 10 is set to +1.5 kV for the positive polarity, which is larger than the absolute value of −1.2 kV for the negative polarity.

3. Voltage Application Timings in First Embodiment

Next, description is made of application timings of the voltage from the charge power source E3 to the cleaning brush 10 and application timings of the voltage from the primary transfer power source E1Y for yellow to the primary transfer roller 5Y for yellow in the first embodiment.

Figure 2:
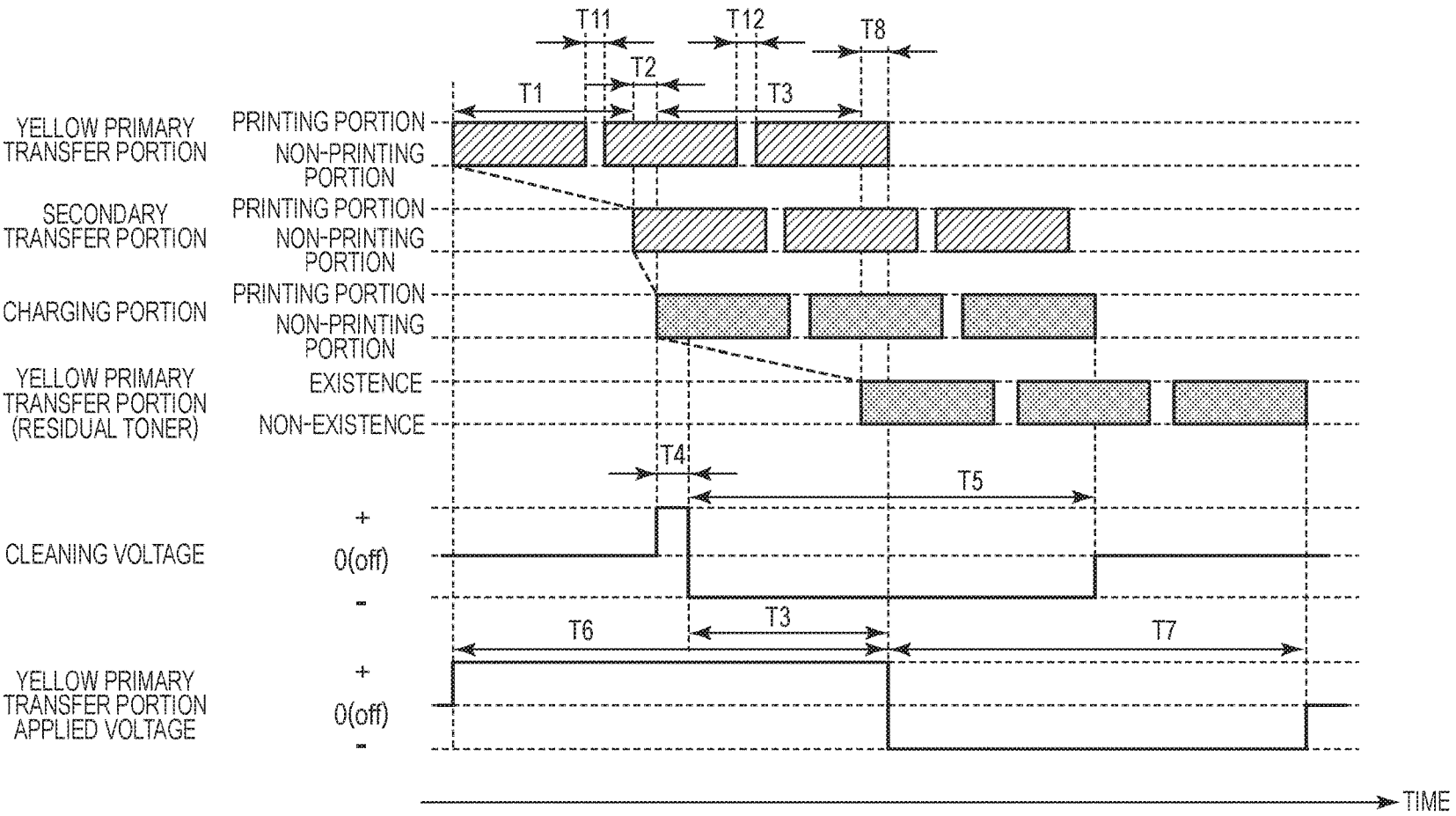
FIG. 2 is a timing chart of a control of the image forming apparatus according to the first embodiment.

FIG. 2 is a timing chart for illustrating application timings of the cleaning voltage and application timings of the voltage to the primary transfer roller 5Y for yellow in a job of successively printing three full-color images. In FIG. 2, there are illustrated three periods (printing portions) during which the toner images on the photosensitive member 1Y for yellow pass through the primary transfer portion N1Y for yellow and three periods (printing portions) during which the toner images on the intermediate transfer belt 7 pass through the secondary transfer portion N2. Further, in FIG. 2, there are illustrated three periods during which the residual toner (positions which are formerly the printing portions) on the intermediate transfer belt 7 passes through the charging portion Ch and three periods during which the residual toner (positions which are formerly the printing portions) on the intermediate transfer belt 7 passes through the primary transfer portion N1Y for yellow.

In FIG. 2, a time period T11 corresponds to a time period between a first sheet and a second sheet, and a time period T12 corresponds to a time period between the second sheet and a third sheet. Further, in FIG. 2, a time period T1 is a time period required for the toner image on the intermediate transfer belt 7 to move from the primary transfer portion N1Y for yellow to the secondary transfer portion N2. Further, in FIG. 2, a time period T2 is a time period required for the residual toner on the intermediate transfer belt 7 to move from the secondary transfer portion N2 to the charging portion Ch. Further, in FIG. 2, a time period T3 is a time period required for the residual toner on the intermediate transfer belt 7 to move from the charging portion Ch to the primary transfer portion N1Y for yellow.

In the first embodiment, the cleaning voltage with the positive polarity is applied to the cleaning brush 10 for a time period T4. After that, the cleaning voltage with the negative polarity is applied to the cleaning brush 10 for a time period T5. In the first embodiment, at a time point at which a residual toner of a first toner image in the job on the intermediate transfer belt 7 arrives at the charging portion Ch, application of the cleaning voltage with the positive polarity to the cleaning brush 10 is started. The cleaning voltage with the positive polarity is applied for the time period T4 because the primary transfer of the toner, which is charged to the negative polarity, on the photosensitive member 1Y to the intermediate transfer belt 7 and the movement of the residual toner, which is charged to the positive polarity, on the intermediate transfer belt 7 to the photosensitive member 1Y are to be simultaneously performed for a time period T8. The time period T5 is a time period for the residual toner of all of the toner images in the job on the intermediate transfer belt 7 to completely pass through the charging portion Ch after the cleaning voltage is switched to the negative polarity.

The timing of switching the cleaning voltage from the positive polarity to the negative polarity corresponds to a timing which is earlier by the above-mentioned time period T3 from the timing of termination of the primary transfer of all of the toner images in the job at the primary transfer portion N1Y for yellow. The time period T3 is a time period required for the residual toner on the intermediate transfer belt 7 to move from the charging portion Ch to the primary transfer portion N1Y for yellow.

Meanwhile, in the first embodiment, the voltage with the positive polarity is applied to the primary transfer roller 5Y for yellow for a time period T6 from the start of the primary transfer of the first toner image in the job at the primary transfer portion N1Y for yellow to termination of the primary transfer of a final toner image. After that, the voltage with the negative polarity is applied to the primary transfer roller 5Y for yellow for a time period T7. The time period T7 is a time period for the residual toner of all of the toner images in the job on the intermediate transfer belt 7 to completely pass through the primary transfer portion N1Y for yellow after the voltage to be applied to the primary transfer roller 5Y is switched to the negative polarity.

As described above, in the first embodiment, the controller 50 executes a control of switching the polarity of the cleaning voltage so that the position on the intermediate transfer belt 7 which passes through the charging portion Ch at the time of the switching arrives at the primary transfer portion N1Y on and after the termination of the primary transfer of all of the toner images in the job. Further, in the first embodiment, the controller 50 executes a control of applying the voltage with the positive polarity to the primary transfer roller 5Y when the position on the intermediate transfer belt 7 which passes through the charging portion Ch during application of the voltage with the positive polarity to the cleaning brush 10 passes through the primary transfer portion N1Y. With this configuration, the residual toner is moved from the intermediate transfer belt 7 to the photosensitive member 1Y with an electrostatic repulsion force. Further, in the first embodiment, the controller 50 executes a control of applying the voltage with the negative polarity to the primary transfer roller 5Y when the position on the intermediate transfer belt 7 which passes through the charging portion Ch at the time of application of the voltage with the negative polarity to the cleaning brush 10 passes through the primary transfer portion N1Y. With this configuration, the residual toner is moved from the intermediate transfer belt 7 to the photosensitive member 1Y with an electrostatic repulsion force. In particular, in the first embodiment, at substantially the same timing as the completion of the primary transfer of all of toner images in the job at the primary transfer portion N1Y for yellow, a leading end of the residual toner charged to the negative polarity on the intermediate transfer belt 7 arrives at the primary transfer portion N1Y for yellow. With this configuration, the amount of toner charged to the positive polarity to be moved to the photosensitive member 1Y can be reduced as much as possible. Further, with this configuration, the time period for application of the cleaning voltage with the positive polarity to the cleaning brush 10 can be reduced as much as possible.

With the above-mentioned voltage application timings, substantially all of the residual toner on the intermediate transfer belt 7 is moved to the photosensitive member 1Y for yellow so as to be collected.

4. Comparative Example

Figure 3:
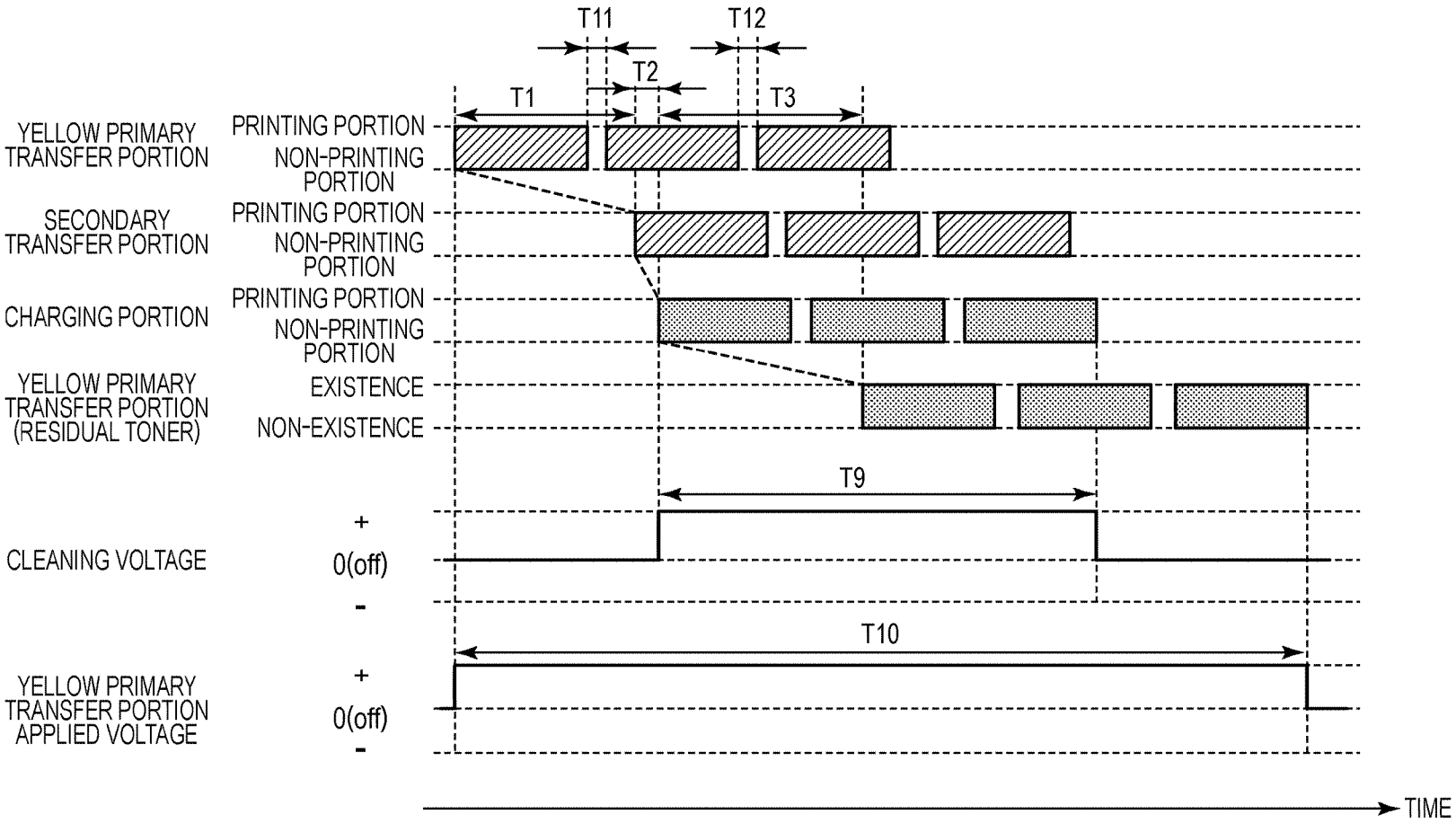
FIG. 3 is a timing chart of a control of the image forming apparatus according to a comparative example.

Next, description is made of voltage application timings of a comparative example. FIG. 3 is a timing chart, which is similar to the timing chart of FIG. 2, for illustrating a comparative example in which only the cleaning voltage with the positive polarity is applied to the cleaning brush 10.

In the comparative example, the cleaning voltage with the positive polarity is applied to the cleaning brush 10 for a time period T9 during which the residual toner of all of the toner images in the job on the intermediate transfer belt 7 passes through the charging portion Ch. Further, in the comparative example, the voltage with the positive polarity is applied to the primary transfer roller 5Y for yellow for a time period T10. The time period T10 is a time period from the start of the primary transfer of the first toner image in the job at the primary transfer portion N1Y for yellow to the termination of passage of the residual toner of all of the toner images in the job on the intermediate transfer belt 7 through the primary transfer portion N1Y for yellow.

In the comparative example, in order to improve performance of the cleaning blade 61 in scraping off the residual toner, the intrusion amount of the cleaning blade 61 with respect to the surface of the photosensitive member 1 is increased from 1.3 mm of the first embodiment to 1.5 mm. Further, in the comparative example, the cleaning voltage is set to +1.5 kV.

5. Effect

For the first embodiment and the above-mentioned comparative example, a lifetime of the process cartridge 20 in the case of repeated successive printing of three full-color images was checked. The lifetime of the process cartridge 20 is determined in accordance with the amount of abrasion of the cleaning blade 61 and the decrease amount of a film thickness of the photosensitive layer of the photosensitive member 1 by abrasion. When any of those conditions reaches a predetermined threshold value, it is determined as termination of the lifetime. According to a result of the check, the first embodiment has reached the lifetime with printing of 18,000 sheets, and the comparative example has reached the lifetime with printing of 15,000 sheets.

It is conceivable that the lifetime of the process cartridge 20 is longer in the first embodiment than in the comparative example because the smaller intrusion amount of the cleaning blade 61 reduces the amount of abrasion of the cleaning blade 61 and the photosensitive member 1.

Further, for the first embodiment and the comparative example, the cleaning performance for the intermediate transfer belt 7 in a case of performing printing of 90,000 sheets in total through repeated successive printing of three sheets from the state of a new product was also checked. According to a result of the check, a cleaning failure did not occur in the first embodiment, whereas a linear cleaning failure occurred in the comparative example.

It is conceivable that the cleaning performance for the intermediate transfer belt 7 was able to be maintained for a longer period of time in the first embodiment than in the comparative example based on the following reasons. In the comparative example, the cleaning voltage was always at +1.5 kV. In contrast, in the first embodiment, the cleaning voltage was switched from +1.5 kV to −1.2 kV before termination of the secondary transfer of all of the toner images in the job. As described above, in the first embodiment, there was provided a period of reducing an absolute voltage value of the cleaning voltage in the job. It is conceivable that such configuration enabled suppression of the amount of adhesion of discharge products, which may cause degradation in application of the electric charge to the residual toner, to the cleaning brush 10.

Further, in the first embodiment, the cleaning voltage with the negative polarity is applied, thereby being capable of obtaining the following effect. The residual toner on the intermediate transfer belt 7 includes the toner charged to the negative polarity and the toner charged to the positive polarity. When the cleaning voltage with the positive polarity is applied to the cleaning brush 10, some toner charged to the negative polarity in the residual toner on the intermediate transfer belt 7 is electrostatically attracted to the cleaning brush 10 during passage through the charging portion Ch. When the amount of toner adhering to the cleaning brush 10 increases, the cleaning brush 10 is degraded in performance of charging the residual toner on the intermediate transfer belt 7 to the positive polarity. In this regard, in the first embodiment, as illustrated in FIG. 2, after the charging voltage with the positive polarity is applied to the cleaning brush 10 for the time period T4, the voltage with the negative polarity is applied for the time period T5. Therefore, the toner which adheres to the cleaning brush 10 and is charged to the negative polarity during the time period T4 receives the electrostatic repulsive force during the time period T5. As a result, the toner is discharged from the cleaning brush 10 to the intermediate transfer belt 7. The discharged toner is moved to the photosensitive member 1Y for yellow so as to be collected together with the residual toner which is charged by the cleaning brush 10 to the negative polarity on the intermediate transfer belt 7. With this configuration, in the first embodiment, it is conceivable that the cleaning brush 10 is restored in performance of charging the residual toner on the intermediate transfer belt 7 to the positive polarity, thereby being capable of suppressing, for a long period of time, occurrence of the failure in cleaning the intermediate transfer belt 7.

As described above, according to the first embodiment, both the cleaning performance for the photosensitive member 1 and the durability of the photosensitive member 1 and the cleaning blade 61 can be achieved, and the cleaning performance for the intermediate transfer belt 7 can be maintained for a long period of time.

Specifically, according to the first embodiment, the residual toner on the intermediate transfer belt 7 is charged to the same polarity as the original charging polarity of the toner as much as possible. With this configuration, the electrostatic attractive force between the residual toner moved to the photosensitive member 1 and the photosensitive member 1 is reduced, thereby being capable of reducing the contact pressure and the intrusion amount of the cleaning blade 61 with respect to the photosensitive member 1. As a result, both the cleaning performance for the photosensitive member 1 and the durability of the photosensitive member 1 and the cleaning blade 61 can be achieved. Further, according to the first embodiment, the voltage and current to be applied to the cleaning brush 10 can be suppressed to change the electric charge of the residual toner on the intermediate transfer belt 7 to the opposite polarity. With this configuration, the rise in electric resistance due to adhesion of the discharge products to the cleaning brush 10 is suppressed, thereby being capable of maintaining the performance of the cleaning brush 10 in charging the residual toner. As a result, the cleaning performance for the intermediate transfer belt 7 can be maintained for a longer period of time. Further, according to the first embodiment, discharging of toner from the cleaning brush 10 can be satisfactorily performed during the secondary transfer offering a degree of freedom in timing of switching the primary transfer bias, rather than during a short time period between sheets. With this configuration, the charging performance of the cleaning brush 10 is restored, thereby being capable of suppressing, for a long period of time, degradation in performance of cleaning the intermediate transfer belt 7.

[Second Embodiment]

Next, another embodiment of the present invention is described. The basic configuration and operation of an image forming apparatus of a second embodiment of the present invention are the same as those of the first embodiment. Thus, in the second embodiment, components having a function or configuration that is the same as or corresponding to those of the first embodiment are denoted by the same reference symbols as those of the first embodiment, and a detailed description thereof is omitted.

1. Configuration of Image Forming Apparatus

Figure 4:
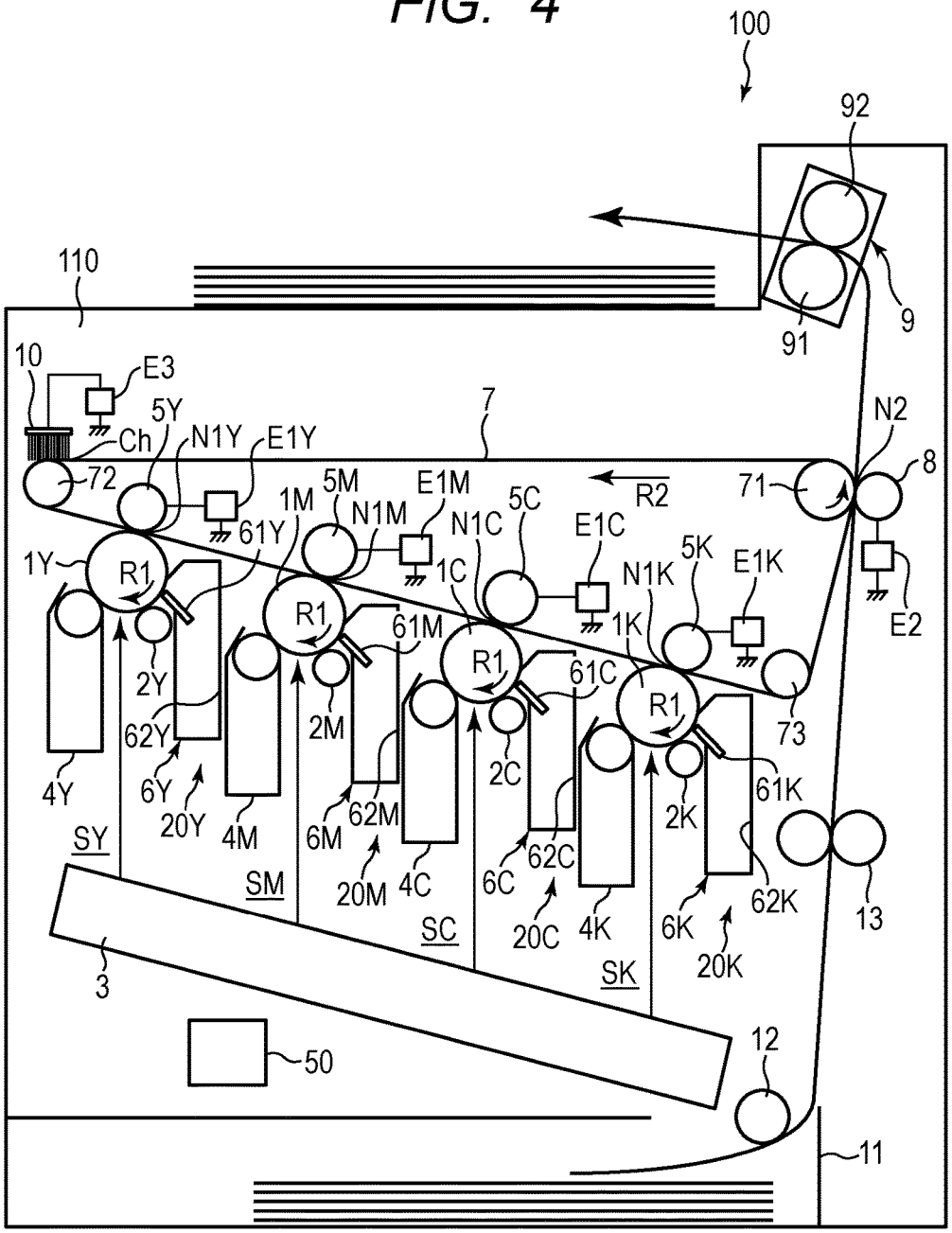
FIG. 4 is a schematic vertical sectional view of the image forming apparatus according to a second embodiment of the present invention.

FIG. 4 is a schematic vertical sectional view of the image forming apparatus 100 according to the second embodiment. The second embodiment is different from the first embodiment in that the cleaning brush 10 is opposed to the tension roller 72 through intermediation of the intermediate transfer belt 7. That is, the secondary transfer portion N2 is formed on the intermediate transfer belt 7 which is looped around the drive roller 71 being one stretch roller of a plurality of stretch rollers for the intermediate transfer belt 7. In the second embodiment, the cleaning brush 10 is arranged opposed to the tension roller 72 being another one stretch roller of the plurality of stretch rollers. The tension roller 72 is a tension roller among the plurality of stretch rollers, which has the intermediate transfer belt 7 looped therearound on downstream of the drive roller 71 and on upstream of the primary transfer portion N1 (primary transfer portion N1Y on the uppermost stream) in the moving direction of the intermediate transfer belt 7.

When the cleaning brush 10 is arranged opposed to the drive roller 71 also serving as the secondary transfer opposed roller as in the first embodiment, the secondary transfer roller 8 and the cleaning brush 10 are arranged close to each other. Therefore, it is conceivable that the secondary transfer voltage and the current supplied by the cleaning voltage interfere with each other along the surface of the intermediate transfer belt 7, with the result that the voltage value to be controlled becomes unstable. It is conceivable that, depending on a case, an image failure due to a secondary transfer failure or a failure in cleaning the intermediate transfer belt 7 due to a failure in charging the residual toner may occur. Such a tendency becomes more conspicuous in the case of applying the secondary transfer voltage with the positive polarity to the secondary transfer roller 8 and the cleaning voltage with the negative polarity to the cleaning brush 10, or in the case where the contrast between the secondary transfer voltage and the cleaning voltage becomes more significant.

In this regard, in the second embodiment, the cleaning brush 10 is arranged opposed to the tension roller 72, with the result that a distance between the secondary transfer roller 8 and the cleaning brush 10 in a circumferential direction of the intermediate transfer belt 7 becomes larger than that of the first embodiment. Therefore, even when there is any change in polarity of the cleaning voltage to be applied to the cleaning brush 10 during the secondary transfer, interference between the secondary transfer voltage and the cleaning voltage can be suppressed.

2. Voltage Application Timings

Figure 5:
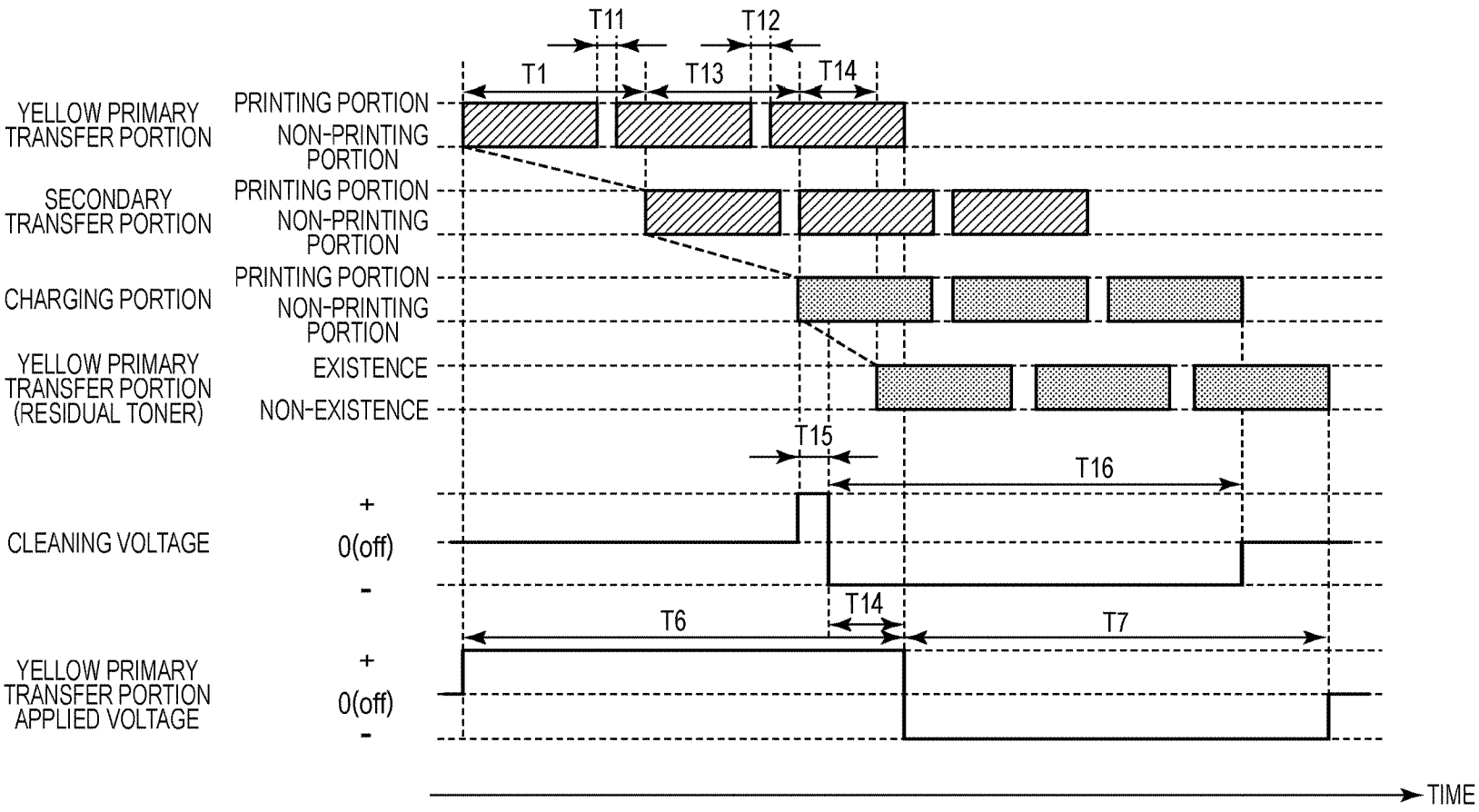
FIG. 5 is a timing chart of a control of the image forming apparatus according to the second embodiment.

Next, description is made of voltage application timings in the second embodiment. FIG. 5 is a timing chart, which is similar to the timing chart of FIG. 2, for illustrating voltage application timings in the second embodiment.

In the second embodiment, the arrangement of the cleaning brush 10 is different from that of the first embodiment. Therefore, a time period T13 corresponding to the time period T2 of FIG. 2 and a time period T14 corresponding to the time period T3 of FIG. 2 are different from those of the first embodiment. Further, in the second embodiment, timings of a time period T15 for applying the cleaning voltage with the positive polarity to the cleaning brush 10 and a time period T16 for applying the cleaning voltage with the negative polarity to the cleaning brush 10 are also different from the time period T4 and the time period T5 of FIG. 2.

Specifically, also in the second embodiment, the application of the cleaning voltage with the positive polarity to the cleaning brush 10 is started at the time point at which the residual toner of the first toner image in the job on the intermediate transfer belt 7 arrives at the charging portion Ch. Further, in the second embodiment, the timing of switching the cleaning voltage from the positive polarity to the negative polarity is a timing which is earlier by the above-mentioned time period T14 from the timing of termination of the primary transfer of all of the toner images in the job at the primary transfer portion N1Y for yellow. The time period T14 is a time period required for the residual toner on the intermediate transfer belt 7 to move from the charging portion Ch to the primary transfer portion N1Y for yellow.

The voltage application timing to the primary transfer roller 5Y for yellow and the voltage value of the cleaning voltage are the same as those of the first embodiment.

As described above, according to the second embodiment, the effect which is the same as that of the first embodiment can be obtained, thereby being capable of reducing the possibility of causing the interference between the cleaning voltage and the secondary transfer voltage.

[Third Embodiment]

Next, another embodiment of the present invention is described. The basic configuration and operation of an image forming apparatus of a third embodiment of the present invention are the same as those of the first and second embodiments. Thus, in the third embodiment, components having a function or configuration that is the same as or corresponding to those of the first and second embodiments are denoted by the same reference symbols as those of the first and second embodiments, and a detailed description thereof is omitted.

1. Configuration of Image Forming Apparatus

Figure 6:
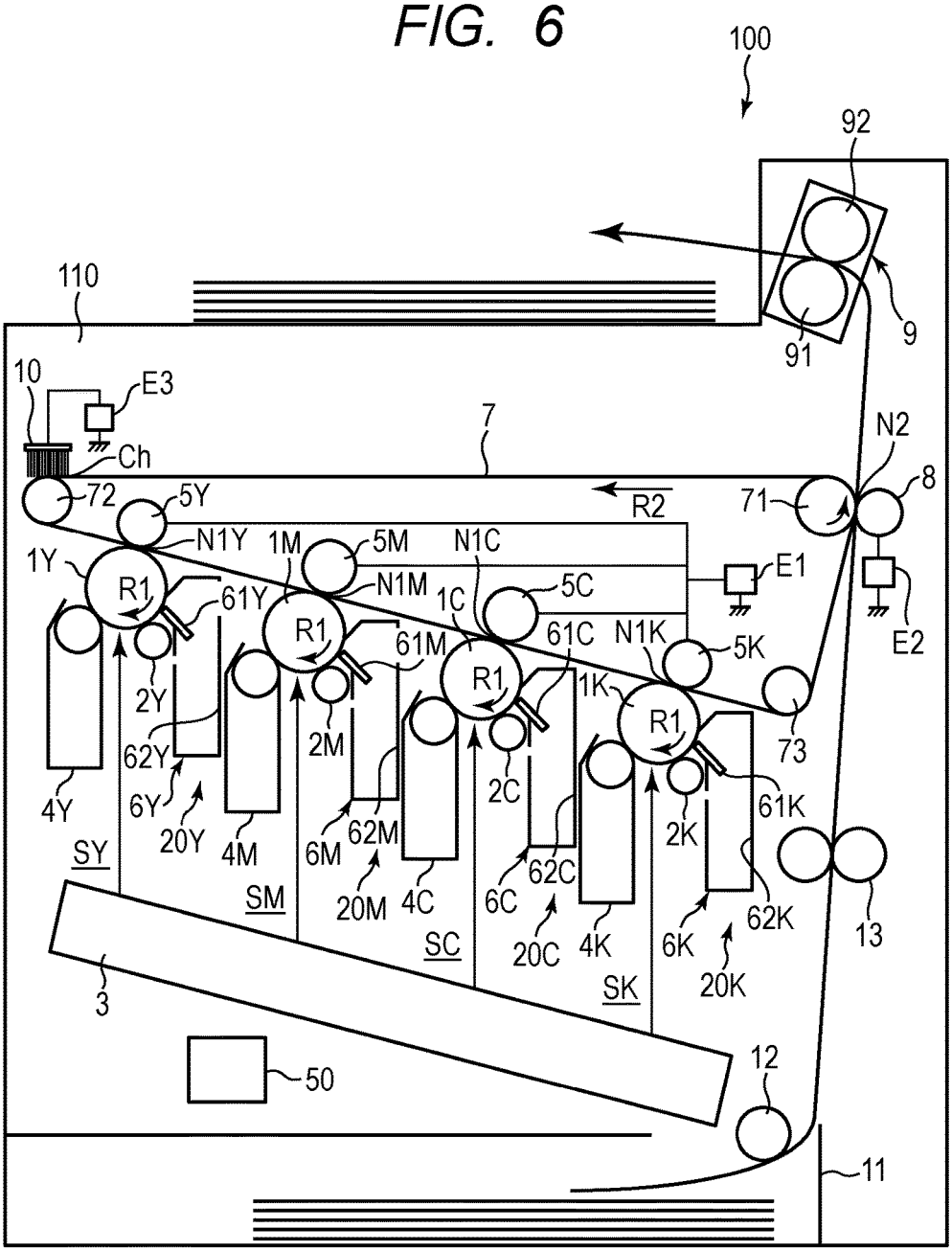
FIG. 6 is a schematic vertical sectional view of the image forming apparatus according to a third embodiment of the present invention.

FIG. 6 is a schematic vertical sectional view of the image forming apparatus 100 according to the third embodiment. The third embodiment is different from the first embodiment in that the primary transfer power source E1 configured to apply a voltage is used in common for all of the primary transfer rollers 5Y, 5M, 5C, and 5K being the plurality of primary transfer members. Thus, in the third embodiment, the voltage with the original charging polarity of the toner or the voltage with the polarity opposite to the original charging polarity of the toner is applied in synchronization by the common primary transfer power source E1 to all of the primary transfer rollers 5Y, 5M, 5C, and 5K.

Further, in the third embodiment, similarly to the second embodiment, the cleaning brush 10 is arranged opposed to the tension roller 72 through intermediation of the intermediate transfer belt 7.

The common primary transfer power source E1 is used to apply the voltage to the plurality of primary transfer portions N1, thereby being capable of reducing manufacturing cost for the image forming apparatus 100. However, when the related-art method of charging the residual toner on the intermediate transfer member to the polarity opposite to the original charging polarity of the toner and moving the residual toner to the photosensitive member so as to be collect is employed, the use of the common primary transfer power source E1 may cause the following problem. When the discharge of toner from the charge member as described in the first embodiment is performed during successive printing, the number of sheets to be printed per unit time may be reduced conspicuously. That is, the toner discharged from the charge member has the same polarity as that of the toner primarily transferred from the photosensitive member to the intermediate transfer member. In this regard, in order to cause the toner discharged from the charge member to move to the photosensitive member, the voltage to be applied to the primary transfer portion is set to have the polarity opposite to that for the primary transfer. At this time, when the common primary transfer power source is used, the voltage to be applied to the primary transfer portion cannot be set to the polarity opposite to that for the primary transfer unless the primary transfer for one sheet at all of the primary transfer portions is completed. Therefore, when the common primary transfer power source is used, it is necessary to significantly extend the time period between sheets to discharge the toner from the charge member as compared to the case where the common primary transfer power source is not used, with the result that the number of sheets to be printed per unit time may be reduced conspicuously.

In this regard, in the third embodiment, similarly to the first and second embodiments, the polarity of the voltage to be applied to the cleaning brush 10 is switched from the positive polarity being opposite to the original charging polarity of the toner to the negative polarity being the same as the original charging polarity of the toner before the termination of all of the secondary transfer in the job. Therefore, even when the common primary transfer power source E1 is used, the toner charged to the original charging polarity is discharged from the cleaning brush 10 during the secondary transfer, thereby being capable of eliminating the need for extending the time period between sheets for the discharge.

2. Voltage Application Timings

Figure 7:
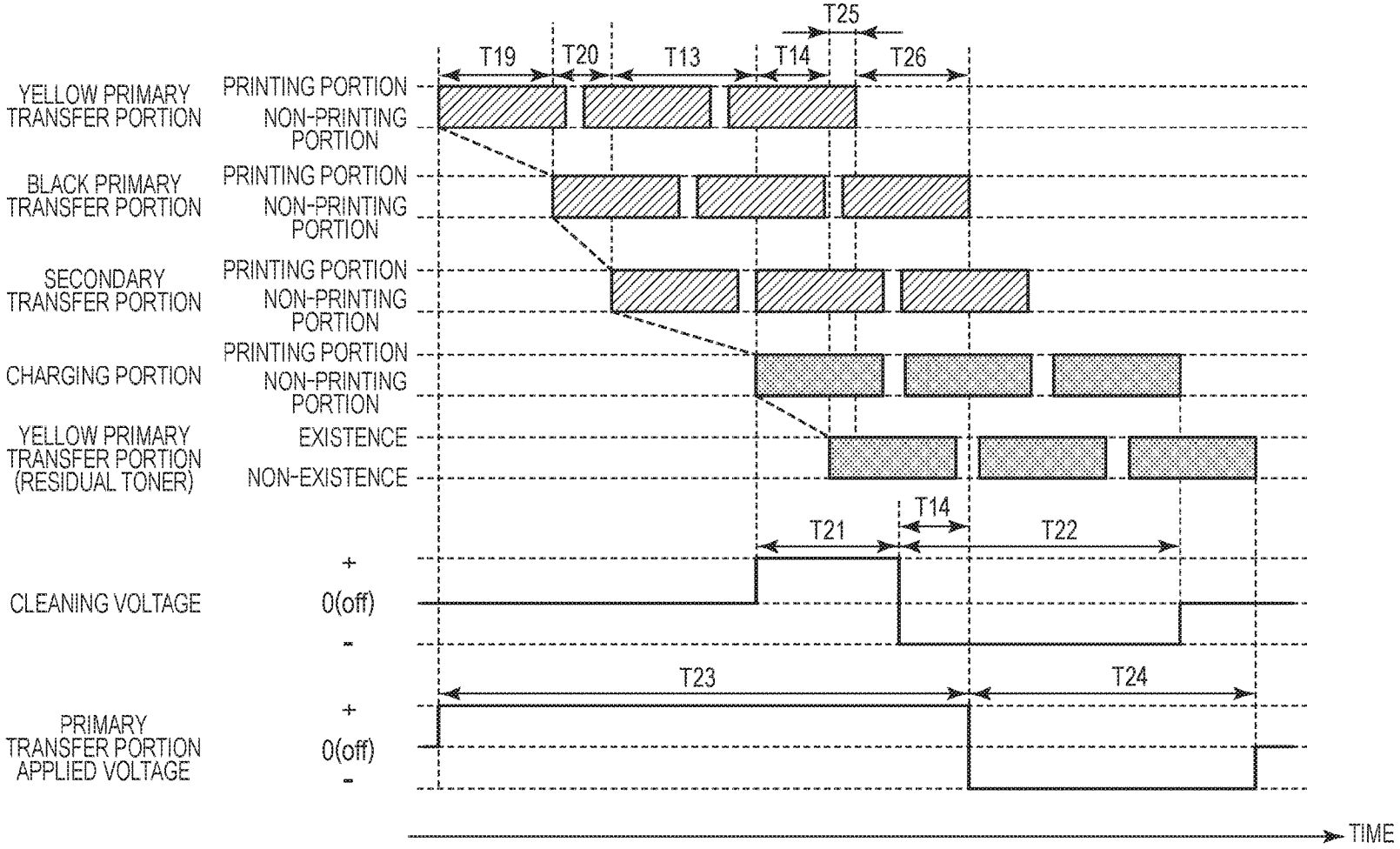
FIG. 7 is a timing chart of a control of the image forming apparatus according to the third embodiment.

Next, description is made of voltage application timings in the third embodiment. FIG. 7 is a timing chart, which is similar to the timing charts of FIG. 2 and FIG. 5, for illustrating voltage application timings in the third embodiment. However, in FIG. 7, there is also illustrated a period during which a toner image on the photosensitive member 1K for black passes through the primary transfer portion N1K for black. Further, in FIG. 7, the voltage to be applied to the primary transfer roller 5 is a voltage to be applied from the common primary transfer power source E1.

In FIG. 7, a time period T19 is a time period required for the toner image on the intermediate transfer belt 7 to move from the primary transfer portion N1Y for yellow to the primary transfer portion N1K for black. Further, in FIG. 7, a time period T20 is a time period required for the toner image on the intermediate transfer belt 7 to move from the primary transfer portion N1K for black to the secondary transfer portion N2.

In the third embodiment, at the time point at which the residual toner of the first toner image in the job on the intermediate transfer belt 7 arrives at the charging portion Ch, application of the cleaning voltage with the positive polarity to the cleaning brush 10 is started, and the cleaning voltage with the positive polarity is applied for a time period T21. After that, the polarity of the cleaning voltage to be applied to the cleaning brush 10 is switched to the negative polarity, and the cleaning voltage with the negative polarity is applied for a time period T22 during which the residual toner of all of the toner images in the job on the intermediate transfer belt 7 completely passes through the charging portion Ch. The voltage value of the cleaning voltage is the same as that of the first and second embodiments.

Here, the timing of switching the cleaning voltage from the positive polarity to the negative polarity is a timing which is earlier by the above-mentioned time period T14 from the timing of termination of the primary transfer of all of the toner images in the job at the primary transfer portion N1K for black. The time period T14 is a time period required for the residual toner on the intermediate transfer belt 7 to move from the charging portion Ch to the primary transfer portion N1Y for yellow.

Meanwhile, in the third embodiment, the common primary transfer power source E1 is used to apply the voltage to all of the primary transfer rollers 5. Therefore, in the third embodiment, the voltage with the positive polarity is applied to all of the primary transfer rollers 5 during a time period T23 from the start of the primary transfer at the primary transfer portion N1Y for yellow to the termination of the primary transfer at the primary transfer portion N1K for black. After that, the voltage to be applied to all of the primary transfer rollers 5 is switched to the negative polarity, and the voltage with the negative polarity is applied to all of the primary transfer rollers 5 for a time period T24 during which residual toner of all of toner images in the job on the intermediate transfer belt 7 completely passes through the primary transfer portion N1Y for yellow.

With the above-mentioned voltage application timings, substantially all of the residual toner on the intermediate transfer belt 7 is moved to the photosensitive member 1Y for yellow so as to be collected. Specifically, at the primary transfer portion N1Y for yellow, during a time period T25, the residual toner charged to the positive polarity simultaneously with the first transfer on the intermediate transfer belt 7 is moved to the photosensitive member 1Y so as to be collected. After that, also during a time period T26 after completion of the primary transfer at the primary transfer portion N1Y for yellow, the residual toner charged to the positive polarity on the intermediate transfer belt 7 at the primary transfer portion N1Y for yellow is moved to the photosensitive member 1Y so as to be collected. After that, at the time point of termination of the primary transfer of all of the toner images in the job at the primary transfer portion N1K for black, the polarity of the voltage applied to all of the primary transfer rollers 5 is switched from the positive polarity to the negative polarity. Further, in conformity with that timing, the polarity of the cleaning voltage is switched from the positive polarity to the negative polarity. With this configuration, at the primary transfer portion N1Y for yellow, the residual toner charged to the negative polarity on the intermediate transfer belt 7 is moved to the photosensitive member 1Y for the time period T24 so as to be collected.

As described above, in the third embodiment, the image forming apparatus 100 includes the common primary transfer power source E1 capable of switching the voltage with the polarity opposite to the original charging polarity of the toner and the voltage with the same polarity as the original charging polarity of the toner and applying the voltages to the plurality of primary transfer rollers 5. Further, in the third embodiment, the controller 50 executes switching of the polarity of the cleaning voltage in the following manner. That is, the position on the intermediate transfer belt 7 which passes through the charging portion Ch at the timing of switching of the polarities of the cleaning voltage arrives at the primary transfer portion N1Y on the uppermost stream on and after termination of the primary transfer of all of the toner images in the job at the primary transfer portion N1K on the downmost stream. Further, in the third embodiment, the controller 50 causes the voltage with the positive polarity to be applied to the plurality of primary transfer rollers 5 when the position on the intermediate transfer belt 7 which passes through the charging portion Ch during application of the voltage with the positive polarity to the cleaning brush 10 passes through the primary transfer portion N1Y on the uppermost stream. Further, in the third embodiment, the controller 50 causes the voltage with the negative polarity to be applied to the plurality of primary transfer rollers 5 when the position on the intermediate transfer belt 7 which passes through the charging portion Ch during application of the voltage with the negative polarity to the cleaning brush 10 passes through the primary transfer portion N1Y on the uppermost stream.

As described above, according to the third embodiment, the effect similar to those of the first and second embodiments can be obtained, and the manufacturing cost for the image forming apparatus 100 can be reduced through use of the common primary transfer power source E1. Further, in the third embodiment, even when the common primary transfer power source E1 is used, the necessity of extending the time period between sheets for discharging of the toner from the cleaning brush 10 can be reduced.

[Others]

The present invention is described above by way of specific embodiments. However, the present invention is not limited to the embodiments described above.

In the above-mentioned embodiments, description is made of the example of formation of the full-color image. When the image forming apparatus has a single color image formation mode of forming an image of a single color such as black, it is only necessary that, in the single color image formation mode, residual toner on the intermediate transfer member be moved to the image bearing member for use in the image formation so as to be collected. At that time, the intermediate transfer member may be separated from image bearing members which are not used for the image formation so that the residual toner on the intermediate transfer member may pass through the image bearing members.

In the above-mentioned embodiments, the charge member configured to charge the toner on the intermediate transfer member is a member of the brush type. However, the charge member is not limited to the brush type and may have another form such as a roller type or a film type. Further, the charge device is not limited to the charge member arranged in contact with the intermediate transfer member. For example, the charge device may be configured to charge the toner through corona discharge, and it is only necessary that the charge member be capable of charging the toner on the intermediate transfer member.

In the above-mentioned embodiments, the primary transfer member is a member of a roller type. However, the primary transfer member is not limited thereto, and may be of another form such as a blade type, a brush type, or a film type.

Further, in the above-mentioned embodiments, the intermediate transfer member is an endless belt looped around the plurality of stretch rollers. However, the intermediate transfer member is not limited thereto. For example, the intermediate transfer member may be of another form such as a drum type film stretched on a frame member. Further, the photosensitive member is not limited to the photosensitive member of the drum type, and may be of, for example, an endless belt type. Further, the image bearing member may be an electrostatic recording dielectric.

According to the present invention, a defect caused by charging the residual toner on the intermediate transfer member to the polarity opposite to the original charging polarity of the toner and moving the residual toner to the image bearing member so as to be collected can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-111356, filed Jun. 2, 2016, which is hereby incorporated by reference herein in its entirety.

What is claimed is:

1. An image forming apparatus, comprising:

an image bearing member configured to bear a toner image thereon;

an intermediate transfer member configured to secondarily transfer the toner image transferred from the image bearing member at a primary transfer portion, onto a transfer material at a secondary transfer portion;

a primary transfer member configured to primarily transfer a toner image from the image bearing member to the intermediate transfer member;

a primary transfer power source capable of switching a voltage with an opposite polarity and a voltage with a same polarity and applying the voltages to the primary transfer member;

a charge device configured to charge a toner on the intermediate transfer member at a charging portion downstream of the secondary transfer portion and upstream of the primary transfer portion with respect to a moving direction of the intermediate transfer member, the toner charged by the charge device being moved at the primary transfer portion from the intermediate transfer member to the image bearing member;

a charge power source capable of switching a voltage with the same polarity as an original charging polarity of the toner and an opposite voltage with a polarity opposite to the original charging polarity of the toner and applying the voltage to the charge device; and a controller configured to execute a control of switching the polarity of the voltage to be applied from the charge power source to the charge device from the opposite polarity to the same polarity before termination of the secondary transfer of all of toner images in a job, and moving residual toner, wherein the controller controls the charge power source so that a position on the intermediate transfer member which passes through the charging portion at a time when a polarity of the voltage applied to the charge device is switched reaches the primary transfer portion when and after termination of the primary transfer for all of the toner images in the job, and wherein the controller controls the primary transfer power source to apply the voltage with the opposite polarity to the primary transfer member when the position on the intermediate transfer member which passes through the charging portion during application of the voltage with the opposite polarity to the charge device passes through the primary transfer portion, and controls the primary transfer power source to apply the voltage with the same polarity to the primary transfer member when the position on the intermediate transfer member which passes through the charging portion during application of the voltage with the same polarity to the charge device passes through the primary transfer portion.

2. An image forming apparatus according to claim 1, wherein the controller is configured to set an absolute value of the voltage with the opposite polarity to be applied from the charge power source to the charge device to be smaller than an absolute value of the voltage with the same polarity to be applied from the charge power source to the charge device.

3. An image forming apparatus according to claim 1, wherein the intermediate transfer member comprises an endless belt looped around a plurality of stretch rollers, and wherein the charge device is arranged opposed to one of the plurality of stretch rollers through intermediation of the endless belt.

4. An image forming apparatus comprising:

a first image bearing member configured to bear a toner image thereon;

an intermediate transfer member configured to secondarily transfer the toner image transferred from the image bearing member at a primary transfer portion onto a transfer material at a secondary transfer portion;

a second image bearing member which is separated from the first image bearing member and arrayed with the first image bearing member along the moving direction of the intermediate transfer member, the second image bearing member being arranged downstream of the first image bearing member;

a plurality of primary transfer members configured to primarily transfer toner images at a plurality of primary transfer portions corresponding to the first image bearing member and the second image bearing member from the image bearing members to the intermediate transfer member;

a charge device configured to charge a toner on the intermediate transfer member at a charging portion downstream of the secondary transfer portion and upstream of the primary transfer portion with respect to a moving direction of the intermediate transfer member, the toner charged by the charge device being moved at the primary transfer portion from the intermediate transfer member to the image bearing members;

a charge power source capable of switching a voltage with the same polarity as an original charging polarity of the toner and a voltage with a polarity opposite to the original charging polarity of the toner and applying the voltage to the charge device;

a common primary transfer power source being capable of switching the voltage with the opposite polarity and the voltage with the same polarity and applying the voltages to the plurality of primary transfer members; and a controller configured to execute a control of switching the polarity of the voltage to be applied from the charge power source to the charge device from the opposite polarity to the same polarity before termination of the secondary transfer of all of toner images in a job, and moving both of a residual toner, which is charged to the opposite polarity through application of the voltage with the opposite polarity to the charge device, on the intermediate transfer member and a residual toner, which is charged to the same polarity through application of the voltage with the same polarity to the charge device, on the intermediate transfer member, to the image bearing members.

5. An image forming apparatus according to claim 4, wherein the controller executes switching of the polarity of the voltage to be applied to the charge device so that the position on the intermediate transfer member which passes through the charging portion at the time of the switching arrives at one of the plurality of primary transfer portions most upstream with respect to the moving direction of the intermediate transfer member on and after termination of the primary transfer of all of toner images in a job at a primary transfer portion formed between the second image bearing member and the intermediate transfer member.

6. An image forming apparatus according to claim 5, wherein the controller controls the primary transfer power source to apply the voltage with the opposite polarity to the plurality of primary transfer members when the position on the intermediate transfer member which passes through the charging portion during application of the voltage with the opposite polarity to the charge device passes through the primary transfer portion formed between the first image bearing member and the intermediate transfer member, and wherein the controller controls the primary transfer power source to apply the voltage with the same polarity to the plurality of primary transfer members when the position on the intermediate transfer member which passes through the charging portion during application of the voltage with the same polarity to the charge device passes through the primary transfer portion formed between the first image bearing member and the intermediate transfer member.

7. An image forming apparatus according to claim 6, wherein the charge device comprises a charge member arranged in contact with the intermediate transfer member.

8. An image forming apparatus according to claim 7, wherein the charge member comprises a member of a brush type.

9. An image forming apparatus comprising:

an image bearing member configured to bear a toner image thereon;

an intermediate transfer member configured to convey a toner image, which is transferred from the image bearing member at a primary transfer portion, to secondarily transfer the toner image onto a transfer material at a secondary transfer portion;

a charge device configured to charge a toner on the intermediate transfer member at a charging portion downstream of the secondary transfer portion and upstream of the primary transfer portion with respect to a moving direction of the intermediate transfer member, the charge device charging, at the charging portion, residual toner which remains on the intermediate transfer member without being transferred to the transfer material at the secondary transfer portion;

a charge power source configured to switch a voltage with the same polarity as an original charging polarity of the toner and a voltage with a polarity opposite to the original charging polarity of the toner and apply the voltages to the charge device; and a controller configured to execute a control of switching the polarity of the voltage to be applied from the charge power source to the charge device from the opposite polarity to the same polarity before termination of the secondary transfer of all of toner images in a job, and moving the residual toner adhering to the charge device from the charge device to the intermediate transfer member, wherein the controller is configured to set an absolute value of the voltage with the opposite polarity to be applied from the charge power source to the charge device to be smaller than an absolute value of the voltage with the same polarity to be applied from the charge power source to the charge device.

* * * * *